US006102972A

United States Patent [19]

Durrant

[11] Patent Number: 6,102,972

[45] Date of Patent: Aug. 15, 2000

[54] METHOD FOR THE REMOVAL OF RUST STAINS FROM FABRIC FIBERS

[75] Inventor: Ed Durrant, Logan, Utah

[73] Assignee: Harris Research, Inc., Logan, Utah

[21] Appl. No.: 09/302,749

[22] Filed: Apr. 30, 1999

Related U.S. Application Data

[60] Provisional application No. 60/083,979, May 1, 1998.

[51] Int. Cl.[7] ..... D06L 1/22

[52] U.S. Cl. ..... 8/137; 510/278; 510/281; 510/282; 510/283; 510/284

[58] Field of Search ..... 8/137; 510/278, 510/281, 282, 283, 284

[56] References Cited

U.S. PATENT DOCUMENTS 921,850 5/1909 Bishop .

1,369,714 5/1921 Gliott .

2,558,013 6/1951 Staubly .

5,215,676 6/1993 Stone .

*Primary Examiner*—Margaret Einsmann

*Attorney, Agent, or Firm*—Thorpe, North & Western

[57] ABSTRACT

An improved method of removing rust stains from carpet and other textiles including application of ammonium bifluoride or other fluoride compounds to a rust stain. If the ammonium bifluoride is unable to remove the stain, an acidifying agent is added to the ammonium bifluoride to generate hydrofluoric acid on the stain. The unreacted hydrofluoric acid is then neutralized and removed along with the stain.

17 Claims, No Drawings

METHOD FOR THE REMOVAL OF RUST STAINS FROM FABRIC FIBERS

This application claims the benefit of the earlier filed provisional application, application No. 60/083,979, filed on May 1, 1998.

FIELD OF THE INVENTION

The present invention relates to a composition and method for the cleaning of carpet and other textiles. More particularly, this invention is directed to the removal of rust spots from carpets and other textiles.

BACKGROUND OF THE INVENTION

Carpet is typically made of synthetic polymeric fibers which are sewn into a backing layer. The backing layer is typically disposed on a foam pad which rests on a flooring surface and the fibers extend upwardly therefrom.

Carpet and other fabric fibers may be soiled in a variety of ways. With carpet, the daily act of walking from outside conditions onto carpet is a common way that soiling may occur. Another soiling condition is caused by the spilling of food, beverages and other contaminates on carpet or other fabric fibers. Further, continuous contact between damp fibers and objects containing iron may also cause rust stains to be deposited.

A less known cause of fabric soiling occurs by the cleaning of carpet and other fibers using some water based cleaners. These cleaners may remove protectants initially applied to the carpet fibers as well as deposit a substantial amount of inorganic salts such as iron, calcium and magnesium salts. Many of these salts involve iron (II) as the cationic member. Because most common carpet cleaners known in the art are water based, the act of cleaning will cause carpet or other fibers to be dampened by those water based cleaners. Although the carpet is dried following the cleaning, some water will inevitably remain on the carpet. Therefore, because the water used for cleaning contains inorganic salts, e.g., iron salts, the very act of cleaning the carpet with a water based cleaner will often deposit these inorganic salts on the carpet fibers. Although thorough rinsing may minimize the iron salt deposition on carpet or other fibers, because rinse water contains iron salts, it will also deposit these undesirable salts onto the fibers.

Iron salts are not per se damaging to the carpet. However, iron salts have the propensity to form carpet discoloration. The discolorations are often the result of the oxidation of these iron salt to an iron oxide species. Most iron oxide species are red or rust colored. As such, the deposit of iron oxide salts on the fibers of the carpet may cause a rust colored stain. Unfortunately, iron oxide salts are water insoluble, thereby precluding their removal through simple, ordinary, washing. Additionally, inorganic salts other than iron oxides can also cause stains on carpet. For example, magnesium and calcium hydroxides are likewise water insoluble and may cause an undesirable discoloration of the carpet.

Carpet cleaners known in the art rely on either surfactants or an effervescing action to lift and remove oil and dirt from the carpet. However, because inorganic salts such as iron oxides are insoluble in water, these cleaners are unable to remove such stains. Moreover, inorganic salts tend to adhere to the carpet fibers and/or become intertwined in the fibers. Through either interaction, the salt particles are not easily washed out of the carpet through conventional means.

Additionally, there are numerous ways in which a carpet becomes soiled and discolored. If the discoloration is caused by insoluble inorganic salts, the cleaning methods known in the art cannot effectively remove the stains. In addition to the oxidation of iron salts, it is not uncommon for a person to contact an item covered with iron oxide (rust) with the person's shoes, etc. The iron oxide is then carried onto the carpet where is often leaves a very noticeable discoloration.

Unfortunately, as indicated above, iron oxide is relatively difficult to remove from carpet and other textiles due in part to its insolubility in water. Thus, for years rust stains on carpet and other fibers were treated with hydrofluoric acid (HF). Hydrofluoric acid, however, is extremely dangerous, in that it can readily burn the skin and has been documented to penetrate the skin and degrade underlying bone. Thus, while hydrofluoric acid was an effective method of removing rust stains, the risks associated with the compound required cleaning companies to find a safer alternative. Thus, most cleaning solutions targeted at the removal of rust use ammonium bifluoride. Like hydrofluoric acid, ammonium bifluoride improves the solubility of rust. Additionally, ammonium bifluoride is safer to use than hydrofluoric acid, but may not be as effective as the more hazardous hydrofluoric acid cleaners.

Therefore, it would be useful to provide a carpet stain removal process that would enable the removal of normally insoluble rust stains, and yet, be as effective as the use of hydrofluoric acid while maintaining a good safety level for those using the process. The salvation of these rust stains in an aqueous environment would allow the stains to be removed from the carpet fibers, regardless of how they were retained by the fibers.

OBJECTS AND SUMMARY OF THE INVENTION

It is therefore an object of the invention to provide an improved method for causing the salvation and removal of rust stains from carpet.

It is a further object of the present invention to cause the colored, water insoluble, rust stains on carpet or other fibers to become discolored and water soluble.

It is still a further object of the present invention to provide a method whereby one or more solutions is added to a rust or similar stain on carpet or other fibers which cause the stain to become discolored and water soluble facilitating the removal of the stain.

Yet another object of the present invention is to provide a safe way of removing rust stains from carpet and other fibers that is as effective as the use of concentrated hydrofluoric acid.

It is still another object of the present invention to provide a method of removing rust stains from fabric so that the fabric fibers are not damaged in any way.

These and other objects of the present invention are realized in specific illustrated embodiments of a method for removing rust stains from a carpet or other textile. The first step requires applying preferably ammonium bifluoride to a carpet. If the ammonium bifluoride is sufficient to remove the stain, a neutralizing agent is added, such as sodium bicarbonate or some other bicarbonate solution. If the rust stain is not removed by the ammonium bifluoride, an acidifying agent, i.e. proton donator or acidic "accelerating" solution, is added to cause a reaction which produces hydrofluoric acid on the carpet. The stain is rubbed out and then a neutralizing agent is added to eliminate the hydrofluoric acid. In accordance with one aspect of the present invention, the neutralizing agent may be sodium bicarbonate. This reaction produces carbon dioxide gas which further helps to remove the stain from the carpet. Any residue left on the carpet is a fluoride salt which may be washed and/or vacuumed away.

DETAILED DESCRIPTION OF THE INVENTION

The invention will now be described in such a manner as to enable one skilled in the art to make and use the invention. It is to be understood that the following description is only exemplary of the principles of the present invention and should not be viewed as narrowing the pending claims.

The method of the invention is accomplished through first, the addition of a solution such as potassium fluoride or preferably ammonium bifluoride to the rust spot or stain on the fibers. Assuming the preferred ammonium bifluoride is used, if the addition of this is sufficient for removal of the stain, the ammonium bifluoride is neutralized and the solution is extracted from the carpet by washing, vacuuming, etc. If the ammonium bifluoride is not sufficient to remove the iron oxide stain, an acidifying solution capable of transferring a proton to the fluoride is added to the area on the carpet which has already been treated with the ammonium bifluoride. An effective acidifying agent will range from strong acids to weak acids having a pKa of less than 4 including sulfuric acid, sulfamic acid, oxalic acid, hydrochloric acid, tartaric acid, hydrogen sulfate ion and/or phosphoric acid. This addition of the acid or proton source causes the formation of hydrofluoric acid on the carpet. While hydrofluoric acid can be dangerous as discussed previously, the amount formed on the carpet through this process is relatively small. Additionally, when coupled with the other steps of the invention, the formation and neutralization of the hydrofluoric acid is actually safer than even the exclusive use of ammonium bifluoride as is done by many carpet cleaning methods.

Next, because the acidifying acids are added, it is desirable to neutralize the acids to prevent damage to carpet or other fibers through prolonged exposure to the acid. This is preferably accomplished by using a neutralizing solution such as sodium bicarbonate, potassium bicarbonate or another bicarbonate solution, which will generate effervescing carbon dioxide as a byproduct of the reaction.

Without limitation due to scientific explanation relative to the functioning of the present invention, the addition of the ammonium bifluoride (or potassium fluoride or other fluoride compound) to an iron oxide based spot or stain in carpet or other fibers is likely to cause the formation of a more soluble iron fluoride salt. Because the iron fluoride salt is more soluble it can be washed out of the carpet fibers. Additionally, because the iron fluoride salt is colorless, its formation creates the illusion of stain removal through the removal of the undesired discoloration prior to actual removal through washing.

In most circumstances it is desirable to add an acidifying agent which enhances the spot cleaning ability. The acidifying agent causes the formation of hydrofluoric acid, a strong proton scavenger and reducing inorganic acid, from the ammonium bifluoride or potassium fluoride. The hydrofluoric acid further causes the formation of the colorless, water soluble iron fluoride salt as well as water soluble salts of other discolorizing inorganic salts including calcium hydroxide. Optional acidifying agents envisioned by this invention include organic acids such as malonic acid, citric acid, tartaric acid and oxalic acid; inorganic acids such as sulfuric acid, sulfamic acid, hydrochloric acid, phosphoric acid and hydrogen sulfate ion may also be used. More generally, the acidifying agent may be any organic or inorganic acid which causes the generation of hydrofluoric acid from the ammonium bifluoride added to the spot to be removed.

Polyester, polyamide or other fibers of modern carpets or other fabrics are not resistant to either acid or base solutions. The prolonged contact of these fibers to either acidic or basic conditions causes destruction of the synthetic or natural substance of which the various fiber are made from. As such, the use of a strong acid to remove rust stains creates the substantial risk of acid induced fiber degradation. Because the outlined method involves the generation of hydrofluoric acid directly on the carpet, the procedure should also include a neutralization step to prevent damage to the carpet. Neutralization is meant to include common acid-base type neutralization reactions now known in the art. The result of this neutralization step is the formation of a neutral salt such as sodium fluoride which is easily washed out of the carpet or other fibers. Additionally, the neutralizing agent of the present invention produces an effervescing gas such as carbon dioxide. The generation of this gas assists in the removal of oil and dirt through a lifting action which brings the dirt and oil to the surface of the carpet. Once the dirt and oil are lifted to the surface of the fiber, simple routine vacuuming will likely eliminate them. The benefits of this lifting action for the cleaning of carpet are known in the art.

Useful neutralizing agents include metal carbonates, bicarbonates, organic carbonates and carbonate salts. However, preferred neutralizing agents include potassium bicarbonate and sodium bicarbonate.

Alternatively, if a neutralizing agent is not added, the method for removing a rust stain from a fabric fiber is disclosed which comprises a) applying an aqueous solution containing a fluoride salt to a rust stain on a fabric fiber; b) subsequently applying an aqueous solution containing an acidifying agent to the stain on the fiber to interact with the fluoride salt, wherein the interaction forms an aqueous hydrofluoric acid solution that reacts with the stain forming a substantially discolored product; and c) extracting the substantially discolored product. Again, with this method, it is preferred that the fluoride salt is selected from the group consisting of ammonium bifluoride and potassium fluoride and the acidifying agent is selected from the group consisting of inorganic acids, organic acids and combinations thereof.

The examples that follow are representative of various methods that may be employed for the removal of carpet discoloration spots or stains due to rust. However, the following should not be considered to limit the present invention. These examples merely teach the best known procedures based upon current experimental data.

EXAMPLES

Solutions

An aqueous rust stain remover was prepared by dissolving 22.8 grams of ammonium bifluoride in water to a final volume of 100 milliliters (mls). The prepared solution has a concentration of 4 moles/liter (M) as ammonium bifluoride and a pH value of about 3.

An acidic "accelerating" solution was prepared by diluting 11 mls of concentrated sulfuric acid (18 M) in water to a final volume of 100 mls. The prepared solution has a concentration of 2 M as sulfuric acid.

A neutralizing solution was prepared by dissolving 7 grams of potassium bicarbonate in water to a final volume of 100 mls. The prepared solution has a concentration of 0.7 M as potassium bicarbonate and a pH value of about 8.5.

For comparative purposes, 4 M hydrofluoric acid was used to test the effectiveness of the rust removing system. The pH value of this solution is less than 1.

Staining Procedure

An oxidizing solution was prepared by dissolving about 15 grams of sodium chloride in 100 mls of 35% hydrogen peroxide.

Rust stains were produced by placing 0.25 grams of super fine (#0000) steel wool on a carpet sample. The steel wool is then treated with 20 mls of the oxidizing solution. Iron oxide (rust) is quickly produced and the carpet sample is allowed to dry overnight before the stain removal process is attempted. This procedure produces stained areas of about 24 $cm^2$.

Example 1

A cream colored nylon carpet was stained with rust as described previously. The stain was treated with 10 mls of 4 M ammonium bifluoride solution. The stain was agitated with a plastic bone scraper to ensure complete solution coverage. The rust color faded slightly due to this initial treatment. The stain was then treated with 10 mls of 2 M sulfuric acid solution and allowed to react for 60 seconds. After this reaction period, no trace of rust was present. The spot was then treated with 0.7 M potassium bicarbonate which resulted in the release of carbon dioxide. This neutralizing solution was added until production of carbon dioxide ceased (about 30 mls). The ceasing of effervescence indicates that the pH of the spot is no longer acidic and the generated hydrofluoric acid has been neutralized to fluoride ion. Finally, the area is rinsed with a wet vacuuming process using water as the rinsing agent. No visible stain remained on the carpet.

Example 2

The procedure of Example 1 was followed with the exception that 10 mls of 4 M hydrofluoric acid was used in place of 4 M ammonium bifluoride and 2 M sulfuric acid solutions. No visible traces of rust remained on the carpet.

Example 3

The procedure of Example 1 was again followed with the exception that the addition of 10 mls of 2 M sulfuric acid was omitted. While the stain was lighter, a visible rust stain remained on the carpet.

Example 4

The procedure of Example 1 was again followed with the exception of substituting 2 M sulfuric acid with the following acids:

A. 4 M phosphoric acid

B. 4 M hydrochloric acid

C. 1 M sulfamic acid

The acids A and B were each effective in removing all traces of rust stain. Acid C left some visible traces of rust but was still much more effective in removing rust than Example 3.

Example 5

The procedure of Example 1 was again followed with the exception of replacing the 4 M ammonium bifluoride with 4 M potassium fluoride solution. Some traces of rust remained on the carpet.

Example 6

A white cotton towel was stained with rust as described previously. The stain was treated with 10 mls of 4 M ammonium bifluoride solution and agitated with a plastic bone scraper to ensure complete solution coverage. The stain was then treated with 10 mls of 2 M sulfuric acid solution and allowed to react for 10 minutes. After this reaction period, only very slight traces of rust were present. The spot was then treated with 30 mls of 0.7 M potassium bicarbonate to neutralize the spot.

Example 7

The procedure of Example 6 was followed with the exception that the 2 M sulfuric acid was substituted with water. The rust stain remained on the towel and appeared unaffected by the treatment.

Example 8

The following material samples were stained with rust, as described above, and treated with 10 mls of 4 M ammonium bifluoride and 10 mls of 2 M sulfuric acid. The samples were allowed to dry for 72 hours and examined for fiber damage.

A. White wool carpet

B. Green and white cotton upholstery fabric

C. Brown and white olefin upholstery fabric

D. Pink polyester carpet

None of these samples showed any signs of fiber damage.

Thus, the present invention discloses an improved method for removing iron oxide stains from fabric, carpet fibers and other fibers. The method is safer than prior art methods and does not cause damage to the underlying fibers or fabric. Those skilled in the art will appreciate numerous modifications which can be made without departing from the scope and spirit of the present invention such as the use of other acidifying agents, neutralizers, bifluoride compounds and underlying fabrics. As such, the appended claims are intended to cover such modifications.

What is claimed is:

1. A method for removing a rust stain from a fabric fiber comprising the steps of:

applying an aqueous solution containing a fluoride salt to a rust stain on a fabric fiber;

subsequently applying an aqueous solution containing an acidifying agent to said stain on said fiber to interact with said fluoride salt, wherein sald interaction forms an aqueous hydrofluoric acid solution that reacts with said stain forming a substantially discolored product; and adding a neutralizing agent to said substantially discolored product on said fiber to neutralize any unreacted hvdrofluoric acid.

2. A method according to claim 1 wherein said fluoride salt is selected from the group consisting of ammonium bifluoride and potassium fluoride.

3. A method according to claim 2 further comprising extracting a neutral salt from said fiber after said neutralization step.

4. A method according to claim 1 wherein said acidifying agent is selected from the group consisting of inorganic acid, organic acid and combinations thereof, and wherein said acidifying agent ranges from strong acids to weak acids having a pKa of less than 4.

5. A method according to claim 4 wherein said acidifying agent is selected from the group consisting of sulfuric acid, sulfamic acid, hydrochloric acid, phosphoric acid, tartaric acid, hydrogen sulfate ion, malonic acid, citric acid and oxalic acid.

6. A method according to claim 1 further comprising the step of extracting said discolored product from said fibers.

7. A method according to claim 6 wherein said substantially discolored product is extracted by a method selected from the group consisting of washing and vacuuming.

8. A method according to claim 1 wherein said step of adding said neutralizing agent to said substantially discolored product on said fiber produces an effervescing gas which assists in removal of said stain on said fiber by lifting said stain to a surface of said fiber.

9. A method according to claim 1 wherein said neutralizing agent is selected from the group consisting of bicarbonates, organic carbonates, carbonate salts and combinations thereof.

10. A method according to claim 9 wherein said neutralizing agent reacts with said unreacted hydrofluoric acid to form a neutral salt.

11. A method according to claim 10 wherein said neutral salt is sodium fluoride.

12. A method according to claim 11 wherein said effervescing gas is carbon dioxide.

13. A method according to claim 11 wherein said stain at said surface is removed by vacuuming.

14. A method according to claim 12 wherein said stain at said surface is removed by washing.

15. A method according to claim 3 further comprising the steps of:

reapplying said aqueous solution containing said fluoride salt to a lightened stain on said fabric fiber; and reapplying said aqueous solution containing said acidifying agent to said lightened stain to form an aqueous hydrofluoric acid solution on said fibers;

allowing said solutions to react with said stain forming a substantially discolored product;

neutralizing said unreacted hydrofluoric acid; and extracting any said solutions from said fibers.

16. A method according to claim 15 wherein said solutions are extracted from said fibers by vacuuming.

17. A method according to claim 15 wherein said solution are extracted from said fibers by washing.

* * * * *